US008136616B2

(12) United States Patent
Padilla et al.

(10) Patent No.: US 8,136,616 B2
(45) Date of Patent: Mar. 20, 2012

(54) OIL CONTROL VALVE DEGRADATION DETECTION AND CLEANING STRATEGY

(75) Inventors: Lauren Elizabeth Padilla, Princeton, NJ (US); John Eric Rollinger, Sterling Heights, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 692 days.

(21) Appl. No.: 12/272,620

(22) Filed: Nov. 17, 2008

(65) Prior Publication Data

US 2010/0122861 A1 May 20, 2010

(51) Int. Cl.
*F01L 1/34* (2006.01)

(52) U.S. Cl. ..... 180/65.28; 123/90.16; 903/905

(58) Field of Classification Search ..... 180/65.27, 180/65.275, 65.28; 123/198 F, 90.11, 90.12, 123/90.15, 90.16; 903/905
See application file for complete search history.

(56) References Cited

U.S. PATENT DOCUMENTS 4,335,429 A * 6/1982 Kawakatsu ..... 701/102
5,971,889 A * 10/1999 Ohashi et al. ..... 477/149
6,006,707 A * 12/1999 Ito ..... 123/90.15
6,405,697 B2 6/2002 Mikame
6,615,779 B2 9/2003 Mae et al.
6,616,570 B2 * 9/2003 Wakashiro et al. ..... 477/5
6,656,089 B2 12/2003 Furukawa
6,692,404 B2 * 2/2004 Matsubara et al. ..... 477/4
6,718,921 B2 4/2004 Grewal et al.
6,874,469 B2 4/2005 Tachibana et al.
6,874,525 B2 4/2005 Kimura et al.
6,912,981 B2 7/2005 Davis et al.
7,214,165 B2 5/2007 Foster et al.

FOREIGN PATENT DOCUMENTS

JP 9195805 7/1997

* cited by examiner

*Primary Examiner* — Frank Vanaman
(74) *Attorney, Agent, or Firm* — Julia Voutyras; Alleman Hall McCoy Russell & Tuttle LLP

(57) ABSTRACT

A method for operating an oil control valve coupled to a cam phaser configured to adjust a position of at least one cam between hard stops, the oil control valve included in an internal combustion engine having an intake valve and/or an exhaust valve controlled via the cam phaser. The method including operating the oil control valve responsive to cam position feedback information, the oil control valve adjusted in a first relationship based on the feedback information and operating the oil control valve in a cleaning mode during select combustion conditions by abruptly switching the oil control valve between two states responsive to the cam position feedback information. The oil control valve adjusted in a second relationship based on the feedback information, the second relationship including more abrupt adjustment than the first relationship.

19 Claims, 10 Drawing Sheets

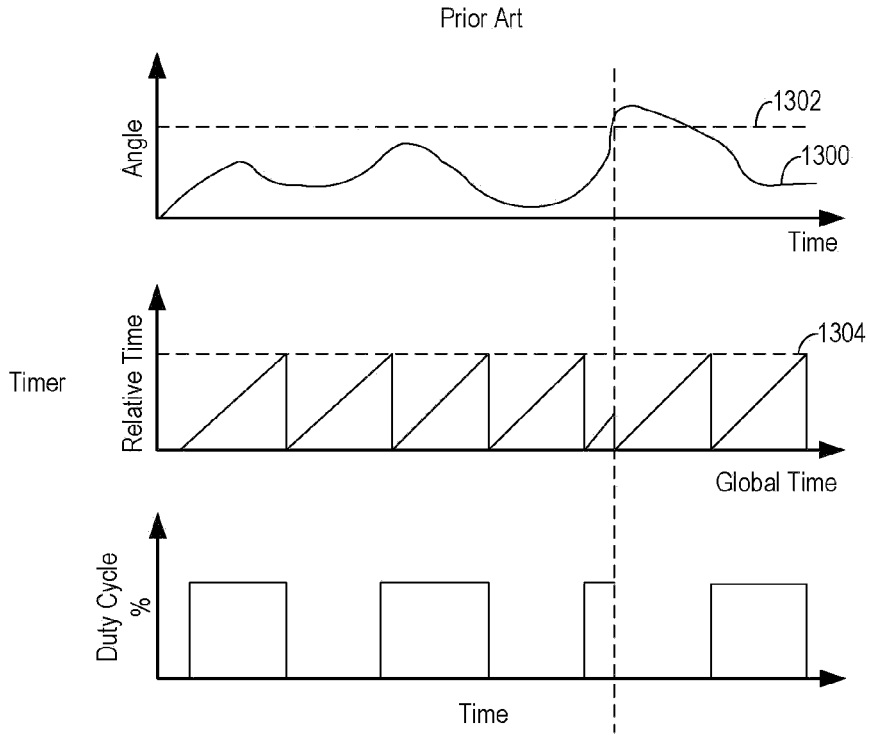
FIG. 13A
FIG. 13B
FIG. 13C
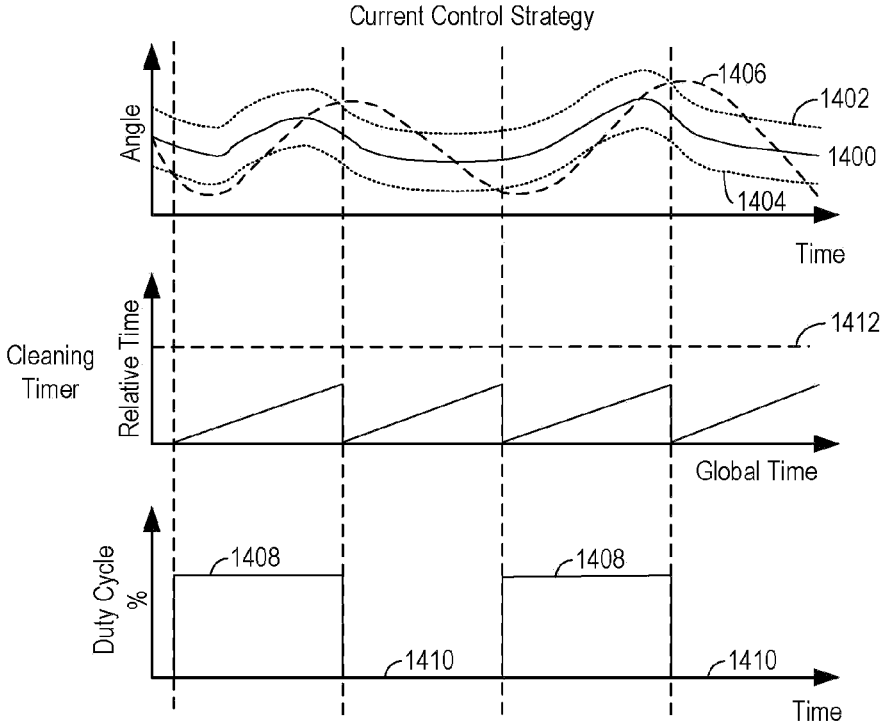
FIG. 14A
FIG. 14B
FIG. 14C

OIL CONTROL VALVE DEGRADATION DETECTION AND CLEANING STRATEGY

BACKGROUND AND SUMMARY

Engines may use variable valve operation, such as variable cam timing, to improve engine performance. In one example, oil control valves, such as spool valves or solenoid valves, may be used to adjust the position (e.g., angle) of the cams via hydraulic actuation of a cam phaser. Therefore, the valve timing may be advanced or retarded depending on the desired valve operation.

Degradation of an oil control valve may occur due to formation of particulates in the hydraulic fluid which may adhere to, or become trapped in, various parts of the valve. The trapped particles may block flow channels, thereby degrading or possibly inhibiting accurate control of oil control valve operation. This may degrade operation of the cams and therefore decrease the efficiency of the combustion process.

Various control strategies have been designed to clean the oil control valve. Such control strategies may be implemented at specified time intervals during engine operation, such as during Deceleration Fuel Shut Off DFSO, when fuel injection is not occurring, when the cam phaser is within a specified range away from the hard stops, and when the valves are substantially stationary. In U.S. Pat. No. 6,718,921, an oil control valve cleaning system and method are disclosed. Cleaning may be implemented, during a limited window of operation, when specified operating conditions are achieved such as non-operation of the fuel injection system, engine torque is within a predetermined range (e.g., below a threshold value), etc.

The inventors have recognized several problems with the above approach. First, the available window of cleaning operation according to such approaches may be very small. Moreover, the available window of operation may be further reduced in vehicles utilizing hybrid technology. For example, DFSO may not occur in a hybrid vehicle, but rather the engine may fully shut-down and come to rest.

As such, in one approach, a method for operating an oil control valve coupled to a cam phaser configured to adjust a position of at least one cam between hard stops, the oil control valve included in an internal combustion engine having an intake valve and/or an exhaust valve controlled via the cam phaser. The method including operating the oil control valve responsive to cam position feedback information, the oil control valve adjusted in a first relationship based on the feedback information and operating the oil control valve in a cleaning mode during select combustion conditions by abruptly switching the oil control valve between two states responsive to the cam position feedback information. The oil control valve adjusted in a second relationship based on the feedback information, the second relationship including more abrupt adjustment than the first relationship.

In this way, a robust valve cleaning strategy may be implemented over a wider range of operating conditions since active valve control may be achieved during the cleaning operation. Further, valve cleaning may be effectively performed during engine operation, thus increasing the available engine shut-down conditions for hybrid vehicle operation, if desired.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE FIGURES

FIGS. 13A-13C graphically illustrates a prior art valve cleaning strategy.

FIGS. 14A-14C graphically illustrates a valve cleaning control strategy.

DETAILED SPECIFICATION

Internal combustion engines may use oil control valves, such as solenoid valves and variable valve operating systems to control actuation of the valve system. For example, oil control valves may be used in cam timing systems to control operation of a cam phaser. Due to potential for particulate and other debris to become lodged in the oil control valve, valve cleaning operations may be carried out.

In one example, a valve cleaning mode of operation is carried out during engine combustion operation and in coordination with modified feedback control of the cam actuation (e.g., cam timing). For example, during non-cleaning conditions, feedback control of cam timing via valve actuation may be carried out with parameters tuned for smooth valve control operation under a wide range of engine operating conditions. However, during select cleaning conditions, a modified feedback control operation, such as using high gain abrupt switching, or bang-bang, feedback control may be used. While this may increase cam angle modulation during combustion, such operation is restricted to selected conditions where such deviations have a reduced or inconsequential impact to drive feel, emissions, and/or engine performance. But at the same time, such higher gain feedback control can sufficiently actuate the oil control valve so as to effect a cleaning operation and reduce or remove contaminants, debris, etc. Further examples and modifications of the various control operations for cylinder valve control are now provided.

Figure 1:
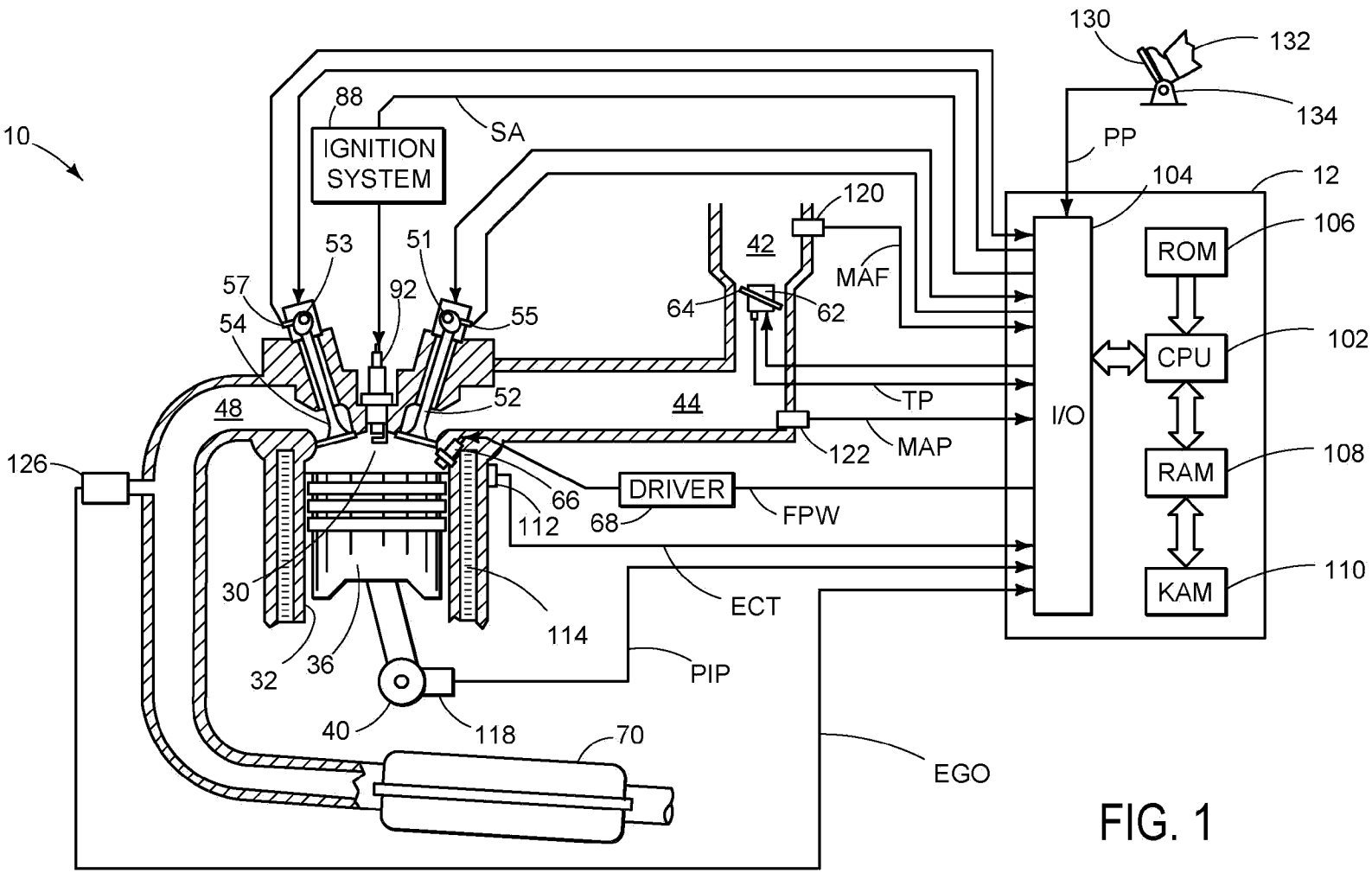
FIG. 1 shows a schematic depiction of an internal combustion engine having a single combustion chamber.

FIG. 1 is a schematic diagram showing one cylinder of multi-cylinder internal combustion engine 10, which may be included in a propulsion system of an automobile. In some examples the propulsion system may additionally include an electric machine configured to produce motive force to drive the vehicle, discussed in more detail herein with regard to FIG. 3. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP. Combustion chamber (e.g. cylinder) 30 of engine 10 may include combustion chamber walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system. Further, a starter motor may be coupled to crankshaft 40 via a flywheel to enable a starting operation of engine 10.

Combustion chamber 30 may receive intake air from intake manifold 44 via intake passage 42 and may exhaust combustion gases via exhaust passage 48. Intake manifold 44 and exhaust passage 48 can selectively communicate with combustion chamber 30 via respective intake valve 52 and exhaust valve 54. In some embodiments, combustion chamber 30 may include two or more intake valves and/or two or more exhaust valves.

In this example, intake valve 52 and exhaust valves 54 may be controlled by cam actuation via respective cam actuation systems 51 and 53. Cam actuation systems 51 and 53 may each include one or more cams and may utilize one or more of cam profile switching (CPS), variable cam timing (VCT), variable valve timing (VVT) and/or variable valve lift (VVL) systems that may be operated by controller 12 to vary valve operation. In this example VCT is utilized. The position of intake valve 52 and exhaust valve 54 may be determined by position sensors 55 and 57, respectively.

Fuel injector 66 is shown coupled directly to combustion chamber 30 for injecting fuel directly therein in proportion to the pulse width of signal FPW received from controller 12 via electronic driver 68. In this manner, fuel injector 66 provides what is known as direct injection of fuel into combustion chamber 30. The fuel injector may be mounted in the side of the combustion chamber or in the top of the combustion chamber, for example. Fuel may be delivered to fuel injector 66 by a fuel system (not shown) including a fuel tank, a fuel pump, and a fuel rail. In some embodiments, combustion chamber 30 may alternatively or additionally include a fuel injector arranged in intake passage 44 in a configuration that provides what is known as port injection of fuel into the intake port upstream of combustion chamber 30.

Intake passage 42 may include a throttle 62 having a throttle plate 64. In this particular example, the position of throttle plate 64 may be varied by controller 12 via a signal provided to an electric motor or actuator included with throttle 62, a configuration that is commonly referred to as electronic throttle control (ETC). In this manner, throttle 62 may be operated to vary the intake air provided to combustion chamber 30 among other engine cylinders. The position of throttle plate 64 may be provided to controller 12 by throttle position signal TP. Intake passage 42 may include a mass air flow sensor 120 and a manifold air pressure sensor 122 for providing respective signals MAF and MAP to controller 12.

Ignition system 88 can provide an ignition spark to combustion chamber 30 via spark plug 92 in response to spark advance signal SA from controller 12, under select operating modes. Though spark ignition components are shown, in some embodiments, combustion chamber 30 or one or more other combustion chambers of engine 10 may be operated in a compression ignition mode, with or without an ignition spark.

Exhaust gas sensor 126 is shown coupled to exhaust passage 48 upstream of emission control device 70. Sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor. Emission control device 70 is shown arranged along exhaust passage 48 downstream of exhaust gas sensor 126. Device 70 may be a three way catalyst (TWC), NOx trap, various other emission control devices, or combinations thereof. In some embodiments, during operation of engine 10, emission control device 70 may be periodically reset by operating at least one cylinder of the engine within a particular air/fuel ratio.

Controller 12 is shown in FIG. 1 as a microcomputer, including microprocessor unit 102, input/output ports 104, an electronic storage medium for executable programs and calibration values shown as read only memory chip 106 in this particular example, random access memory 108, keep alive memory 110, and a data bus. Controller 12 may receive various signals from sensors coupled to engine 10, in addition to those signals previously discussed, including measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; and absolute manifold pressure signal, MAP, from sensor 122. Engine speed signal, RPM, may be generated by controller 12 from signal PIP. Manifold pressure signal MAP from a manifold pressure sensor may be used to provide an indication of vacuum, or pressure, in the intake manifold.

Storage medium read-only memory 106 can be programmed with computer readable data representing instructions executable by processor 102 for performing the methods described below, as well as other variants that are anticipated but not specifically listed.

As described above, FIG. 1 shows only one cylinder of a multi-cylinder engine, and that each cylinder may similarly include its own set of intake/exhaust valves, fuel injector, spark plug, etc.

Figure 2:
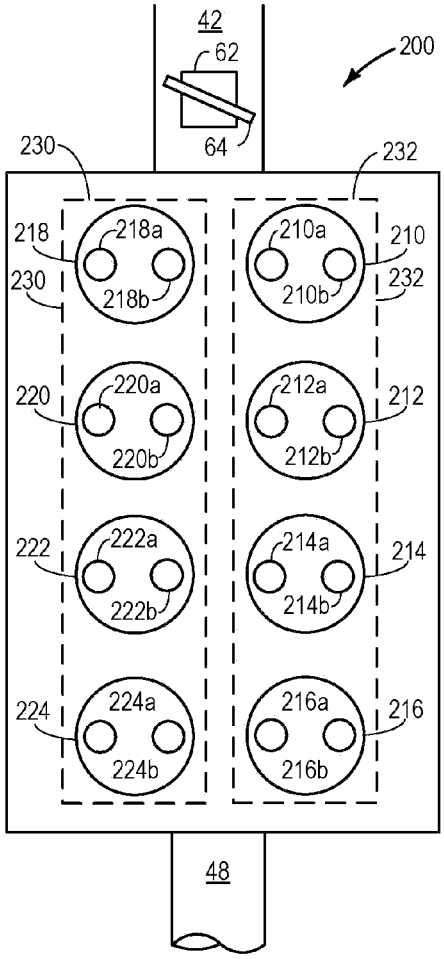
FIG. 2 shows a schematic depiction of an internal combustion engine having multiple cylinder banks.

FIG. 2 shows a schematic depiction of an internal combustion engine 200. It can be appreciated that internal combustion engine 10 may be one cylinder of engine 200. Therefore, similar parts are labeled accordingly. In this example, the internal combustion engine includes eight cylinders, 210, 212, 214, 216, 218, 220, 222, and 224, respectively. The cylinders are fluidly coupled to the intake passage 42 and the exhaust passage 48. The intake may include a throttle 62 having a throttle plate 64. A left cylinder bank 230 includes cylinders (218, 220, 222, and 224) and a right cylinder bank 232 includes cylinders (210, 212, 214, and 216). Furthermore, each cylinder may include an intake and exhaust valve, the first cylinder includes an intake valve 210A and an exhaust valve 210B. The second cylinder includes an intake valve 212A and an exhaust valve 212B, and so on and so forth. Each valve may be actuated via a cam coupled to a cam shaft. A plurality of cam shafts may be included in the engine. For example, two double overhead cam shafts may be positioned in each engine bank, allowing the intake valve and exhaust valves in each engine bank to be independently actuated and adjusted.

Additionally, a plurality of cam phasers may be included in the engine. In some examples, a cam phaser may be coupled to each cam shaft. For instance, when two double overhead cam shafts are utilized, a cam phaser may be coupled to each of the intake cam shaft and the exhaust cam shaft in each engine bank, allowing the position of the cams for the intake and the exhaust valves in each engine bank to be independently adjusted. Alternatively, the number of cam phasers may be altered depending on the configuration of the engine. The cam phasers may be adjusted, via oil control valves, to advance or retard the timing of the cylinder valves in the engine, discussed in more detail herein with regard to FIG. 4.

Figure 3:
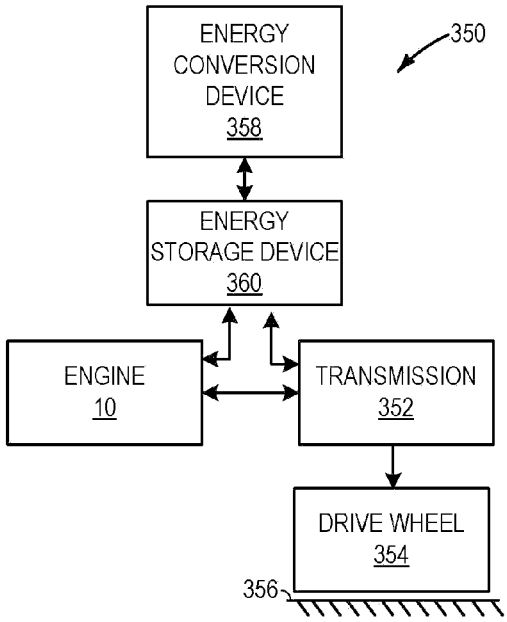
FIG. 3 shows a schematic depiction of a hybrid-electric propulsion system.

In some examples, the vehicle may utilize a hybrid-electric propulsion system 350 shown in FIG. 3. In other examples, the vehicle may not use a hybrid-electric propulsion system. Hybrid-electric propulsion system 350 may include internal combustion engine 10 coupled to transmission 352. Transmission 352 may be a manual transmission, automatic transmission, or combinations thereof. Further, various additional components may be included, such as a torque converter, and/or other gears such as a final drive unit, etc. Transmission 352 is shown coupled to drive wheel 354, which in turn is in contact with road surface 356.

In this example embodiment, the hybrid-electric propulsion system 350 also includes energy conversion device 358. The energy conversion device may include a motor, a generator, among others and combinations thereof. The energy conversion device 358 is further shown coupled to an energy storage device 360, which may include a battery, a capacitor, a flywheel, a pressure vessel, etc. The energy conversion device can be operated to absorb energy from vehicle motion and/or the engine and convert the absorbed energy to an energy form suitable for storage by the energy storage device (i.e. provide a generator operation). The energy conversion device can also be operated to supply an output (power, work, torque, speed, etc.) to the drive wheels 354 and/or engine 10 (i.e. provide a motor operation). It should be appreciated that the energy conversion device may, in some embodiments, include only a motor, only a generator, or both a motor and generator, among various other components used for providing the appropriate conversion of energy between the energy storage device and the vehicle drive wheels and/or engine.

The depicted connections between engine 10, energy conversion device 358, transmission 352, and drive wheel 354 indicate transmission of mechanical energy from one component to another, whereas the connections between the energy conversion device and the energy storage device may indicate transmission of a variety of energy forms such as electrical, mechanical, etc. For example, torque may be transmitted from engine 10 to drive the vehicle drive wheels 354 via transmission 352. As described above energy storage device 360 may be configured to operate in a generator mode and/or a motor mode. In a generator mode, system 350 absorbs some or all of the output from engine 10 and/or transmission 352, which reduces the amount of drive output delivered to the drive wheel 354, or the amount of braking torque to the drive wheel 354. Such operation may be employed, for example, to achieve efficiency gains through regenerative braking, improved engine efficiency, etc. Further, the output received by the energy conversion device may be used to charge energy storage device 360. In motor mode, the energy conversion device may supply mechanical output to engine 10 and/or transmission 352, for example by using electrical energy stored in an electric battery.

Hybrid propulsion embodiments may include full hybrid systems, in which the vehicle can run on just the engine, just the energy conversion device (e.g. motor), or a combination of both. Assist or mild hybrid configurations may also be employed, in which the engine is the primary torque source, with the hybrid propulsion system acting to selectively deliver added torque, for example during tip-in or other conditions. Further still, starter/generator and/or smart alternator systems may also be used. Also, it can be appreciated that engine 10 may not be included in a hybrid-electric system. The various components described above with reference to FIG. 3 may be controlled by a vehicle controller 12, shown in FIG. 1.

From the above description, it should be understood that the exemplary hybrid-electric propulsion system is capable of various modes of operation. In a full hybrid implementation, for example, the propulsion system may operate using energy conversion device 358 (e.g., an electric motor) as the only torque source propelling the vehicle. This "electric only" mode of operation may be employed during braking, low speeds, while stopped at traffic lights, etc. In another mode, engine 10 is turned on, and acts as the only torque source powering drive wheel 354. In still another mode, which may be referred to as an "assist" mode, the alternate torque source 358 may supplement and act in cooperation with the torque provided by engine 10. As indicated above, energy conversion device 358 may also operate in a generator mode, in which torque is absorbed from engine 10 and/or transmission 352. Furthermore, energy conversion device 358 may act to augment or absorb torque during transitions of engine 10 between different combustion modes (e.g., during transitions between a spark ignition mode and a compression ignition mode).

Figure 4:
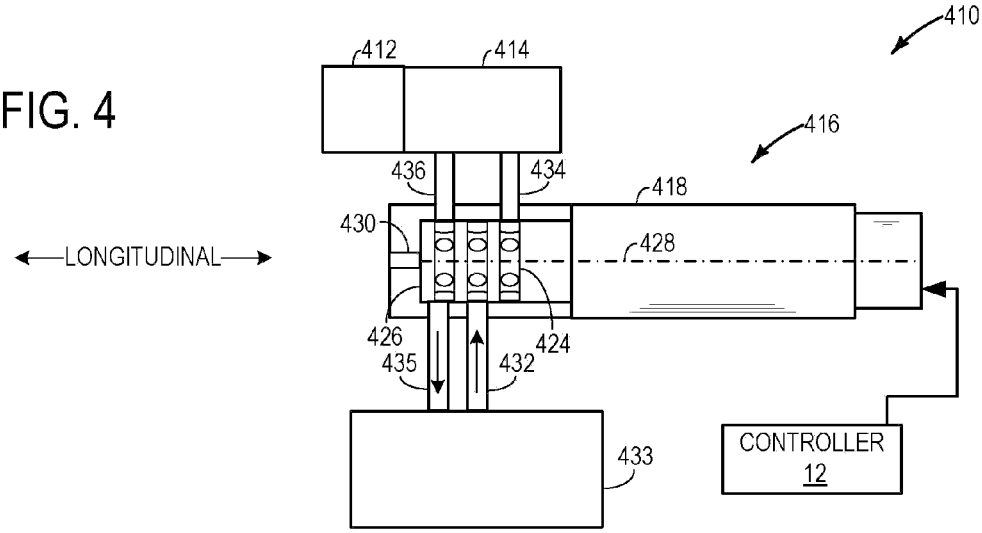
FIG. 4 shows a schematic depiction of a solenoid valve.

FIG. 4 illustrates a schematic depiction of a cam actuation system 410, which may be included in cam actuation system 51 and/or 53, shown in FIG. 1. Alternatively, cam actuation system 410 may be another suitable cam actuation system. The cam actuation system may be configured to adjust the position of one or more cams 412 via hydraulic adjustment of a cam phaser 414, thereby adjusting the timing of an intake or exhaust valve, such as intake valve 52 or exhaust valve 54, shown in FIG. 1.

Continuing with FIG. 4, the cam actuation system may include a solenoid valve 416 configured to direct fluid to a cam phaser 414 operably coupled to one or more cams 411. The cam phaser is configured to adjust the position of the cams (e.g. advance or retard timing relative to the crankshaft) during operation of the engine, in which combustion occurs in the cylinders. In some examples, the solenoid valve 416 may be a suitable valve such as a spool valve utilizing a hydraulic fluid. However, it can be appreciated that alternate types of oil control valves and/or fluids may be utilized.

The solenoid valve 412 may include an electromagnetic solenoid 418 configured to receive a commanded signal, such as a Pulse Width Modulation PWM signal (e.g. duty cycle), from controller 12. In other examples, another suitable controller may be used to send the commanded signals to the electromagnetic solenoid.

Furthermore, the solenoid valve may include an armature (not shown) coupled to a spool 424 included in a valve body 426. The armature, spool, and valve body all share a common central axis 428. During adjustment of the solenoid valve, the armature, spool, and valve body may move in a longitudinal direction, responsive to a commanded signal from the controller. The valve body may be coupled to a mechanism 430, such as a spring, allowing the solenoid valve to return to a de-energized position when the valve is no longer receiving a command signal. In other examples, mechanism 430 may be coupled to other components in the valve, such as the armature.

Further, an inlet conduit 432 configured to direct fluid (e.g. oil) into the valve, may be included in the valve. A fluid delivery system 433 configured to deliver pressurized fluid to the inlet conduit may be included in the cam actuation system. A return conduit 435 may be fluidly coupled to the solenoid valve and the fluid delivery system. Additionally, a first and a second outlet conduit, 434 and 436 respectively, may be included in the solenoid valve. The location of the spool within the solenoid valve, as well as the spool design, may determine the amount of fluid (e.g. oil) that flows through the solenoid valve into a first and/or second outlet conduit.

In this example, the solenoid valve has two commanded states, on and off (e.g. energized and de-energized). A command signal, such as Pulse Width Modulation Signal PWM, may be used to accurately control the position of the valve, allowing the valve (armature, spool, and/or valve body) to substantially maintain a specified longitudinal position (e.g. substantially steady state). As discussed herein, the commanded signal is a PWM signal (e.g. duty cycle). However, it can be appreciated that alternative command signals may be utilized to adjust the relative position of the armature, spool, and valve body, such as a current level command, voltage level command, etc.

Additionally, the solenoid valve may be positioned in a first configuration and in a second configuration. In the first configuration, fluid may be directed through outlet conduit 434 to advance the angle of the cam. Conversely, in the second configuration, fluid may be directed through conduit 436 to retard the angle of the cam. It can be appreciated that additional or alternative configurations may be used to advance or retard the cam angle.

The first and second configuration may have a corresponding PWM signal range or value. For example, the first configuration may correspond with a duty cycle of 100% and the second configuration may correspond with a duty cycle of 0%. However, it can be appreciated that countless other values or ranges of possible correspondence between the PWM signal and the configurations of the valve are possible. In another example, the first and second configurations (e.g. commanded states) of the solenoid valve may correspond to end regions of valve actuation.

Furthermore, the valve may be positioned in additional configurations, such as a third configuration. The third configuration may direct fluid through the first and second outlet conduits, allowing the position of the cam phaser to be substantially maintained. In this way, the position of the cam phaser may be substantially stationary, relative to the motion of the cams, allowing the current valve timing to be maintained.

Cam phaser 414 may be a suitable phaser, such as a vane phaser. It can be appreciated that the cam phaser may include various components such as a stator, rotor, vanes, springs, etc. The aforementioned components may work in conjunction to direct the fluid from the solenoid valve in various ways to adjust the position (e.g. angle) of the cam(s). In this way, the cam phaser may be configured to advance or retard the valve timing.

In some examples, cam actuation system 410 may include an energized hard stop and a de-energized hard stop, impeding (e.g. preventing) the cam phaser from advancing or retarding the cam beyond a specified angle. The energized hard stop may be configured to impede (e.g. inhibit) the motion of the cam phaser when the hydraulic control valve is energized (e.g. commanded via a PWM signal≈100%) and is delivering fluid to advance the cam angle. The de-energized hard stop may be configured to impede (e.g. inhibit) the motion of the cam phaser when the hydraulic control valve is not energized (e.g. commanded via a PWM signal≈0%) and is delivering fluid to retard the cam angle. In an alternate example, the de-energized hard stop may be configured to impede the motion of the cam phaser when the solenoid valve is not energized and delivering fluid to advance the cam angle.

Additionally, it can be appreciated that a locking mechanism, such as a locking pin, may be included in cam actuation system 410, allowing the phaser to be locked into position at specified angles. The locking mechanism may be configured to lock the phaser into a fully advanced or fully retarded position at the energized and de-energized hard-stops. In one example, the locking mechanism may be an electromagnetic locking mechanism. In another example, the locking mechanism may be a mechanically actuated locking mechanism.

Various control strategies may be used to control operation of the solenoid valve. The control strategies may include various modes of solenoid valve control and operation. In one example, a feedback control strategy may be used to control the solenoid valve or other suitable oil control valve, in a first mode, during operation of the engine while combustion occurs in the cylinders having valve timing controlled. The feedback control strategy may include operating the solenoid valve responsive to cam position feedback information, where the solenoid valve is adjusted in a first relationship based on the feedback information. Cam position feedback information may include measurements of the cam angle relative to crank angle, for example. An exemplary first relationship may include a feedback control strategy as shown in FIG. 5.

The above feedback control strategy using the first relationship may be discontinued and a valve cleaning strategy may be implemented during select engine operating conditions. The valve cleaning mode may constitute, or be included in, a second mode to clean the valve to remove unwanted particulates from the valve. The second mode may include feedback control of valve position (e.g., cam angle) using a second relationship that may include abruptly switching the solenoid valve between two states responsive to cam position feedback information. FIGS. 6-12 illustrate various cleaning strategies which may be implemented during operation of the internal combustion engine.

Figure 5:
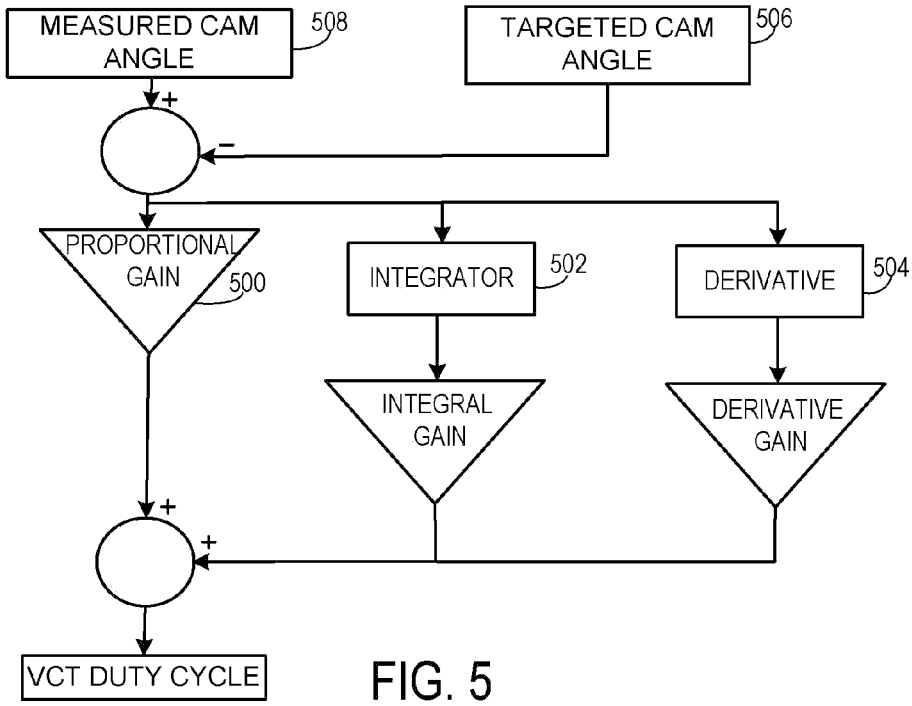
FIG. 5 illustrates a proportional integral derivative feedback control strategy.

FIG. 5 shows an exemplary Proportional Integral Derivative PID control strategy 500. Control strategy 500 may be used to control an oil control valve, such as solenoid valve 316, during operation of the engine when a valve cleaning control strategy is not being implemented. Three parameters are utilized in this type of feedback control: proportional 500, integral 502, and derivative values 504. A target cam angle 506 is used as the set point input and a measured cam angle 508 is used as the process variable input. The proportional value determines the reaction to the current error, the integral determines the reaction based on the sum of recent errors and the derivative determines the reaction to the rate at which the error has been changing. The weighted sum of these three actions is used to adjust the process via a control element such as the position of a control valve (e.g. VCT duty cycle). It can be appreciated that alternate feedback control strategies may utilized such as Proportional Integral (PI) control, a combination of feed-forward control and PID control, and various others.

FIGS. 6-12 illustrate a number of control strategies utilized to clean an oil control valve (e.g. solenoid valve) over a range of engine operating conditions during which at least one cylinder of an internal combustion engine is carrying out combustion. As mentioned above, the control strategies may be included in a cleaning mode in which the oil control valve is adjusted to clean the valve during engine combustion operation. In some examples, the control strategies may be performed periodically at regular timer intervals during operation of the engine and/or during selected vehicle and/or engine operating conditions. Alternatively, the timer intervals between implementation of the valve cleaning controls strategy may be adjusted based on a number of vehicle and/or engine operating conditions. The control strategies set forth in FIGS. 6-12 may be implemented utilizing the system and components described above. However, it can be appreciated that the control strategies set forth in FIGS. 6-12 may be implemented utilizing other suitable components.

In some examples, when the control strategies may be implemented in a vehicle having a hybrid-electric propulsion system, the frequency of execution of the valve cleaning control strategies may be adjusted responsive to a quantity and/or duration of internal combustion engine shut down events. A shut down event may include an event in which the valves are seated and sealed and fuel injection is discontinued, and the engine spins down to rest (with the vehicle propelled and/or controlled via the electrical machine). In one example, as the quantity of internal combustion shut down events are increased, the frequency of execution of the valve cleaning control strategies during engine combustion operation may be increased. In other words, during such operation, the engine operates less frequently. Thus, when the engine does operate, a greater portion of the engine operation is devoted to valve cleaning, than compared with conditions in which the engine operates more frequently or for longer durations (e.g., highway operation).

Although, the valve cleaning strategies are discussed with regard to a single valve, it can be appreciated that the valve cleaning strategies may be used to clean a number of valves at substantially concurrent, overlapping, successive, or separate intervals. In one example, substantially concurrent cleaning of the oil control valves (e.g. solenoid valves) in an engine bank may be inhibited; rather, in the example of dual overhead cams each with independent variable cam timing, the intake cam timing oil control valves may first be cleaned, and then the exhaust cam timing oil control valves may be cleaned (in a particular bank). In this way, combustion effects due to more abrupt cam timing adjustments can be reduced. In another example, cleaning of valves in separate engine banks may be carried out independently. In this way, the engine banks may operate independently in the first and second modes.

Figure 6:
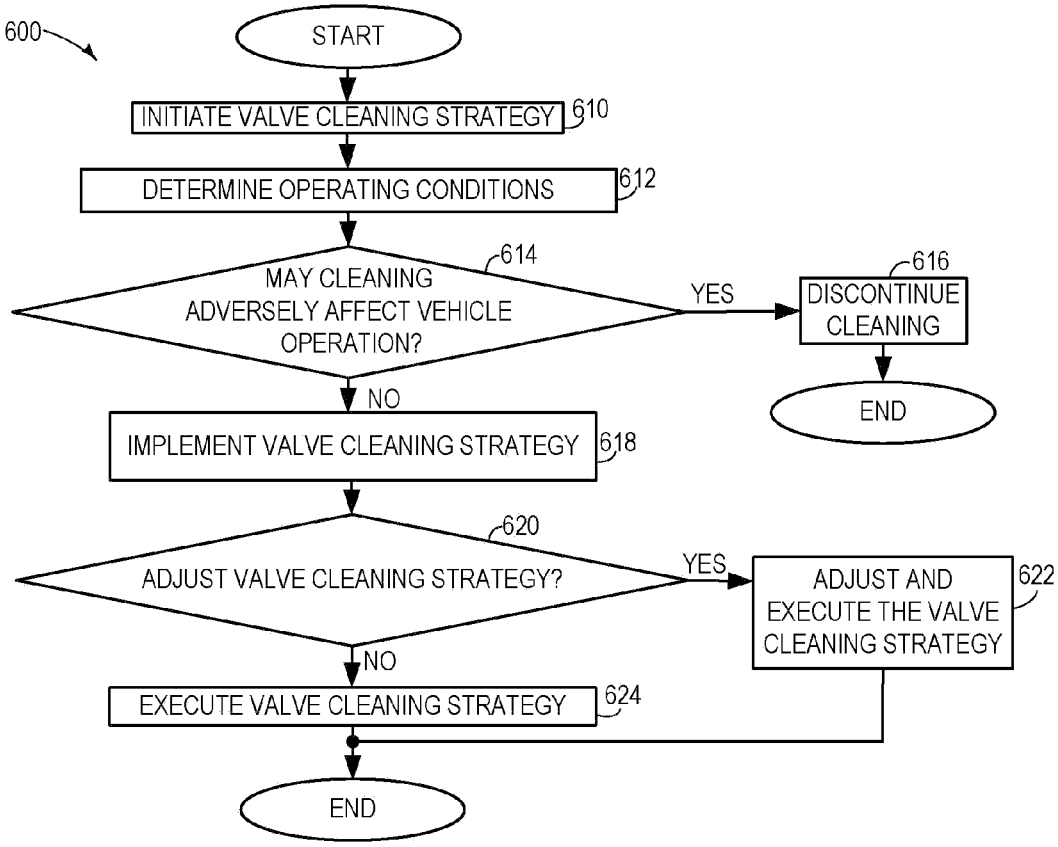
FIG. 6 shows an oil control valve cleaning strategy.

FIG. 6 shows a high level robust valve cleaning strategy which may be implemented to perform valve cleaning over a selected window of engine operation. At 610 the control strategy may include initiating the valve cleaning strategy. Initiating cleaning may include implementing code in a suitable control system or a controller. Next, at 612, operating conditions are determined. The operating conditions may include the desired cam angle, the actual (e.g. measured) cam angle, vehicle temperature, engine torque, desired engine torque, etc.

Next, the control strategy advances to 614 where it is determined if cleaning may adversely affect vehicle operation. Adverse affects on the vehicle may include increasing the emissions of the vehicle, adjusting the power output of the engine, etc. If it is determined that the cleaning cycle may adversely affect vehicle operation, the control strategy proceeds to 616 where the valve cleaning strategy is discontinued, after which the routine ends.

However, if it is determined that the control strategy may not adversely affect vehicle operation, the control strategy advances to 618 where a valve cleaning strategy is implemented. In some examples, the valve cleaning strategy may be a bang-bang type control strategy.

The control strategy then advances to 620 where it is determined if the valve cleaning strategy should be adjusted responsive to a number of operation conditions such as cam position, vehicle temperature, desired cam positions, power output, etc. In some examples, adjustment may include adjusting the duration of the cleaning strategy. If it is determined that the valve cleaning strategy is to be adjusted, the routine advances to 622 where the valve cleaning strategy is adjusted and the modified strategy is executed. Adjustment of the strategy may include adjusting the duration, timing, etc., of the strategy. However, if it is determined that the valve cleaning strategy should not be adjusted, the routine advance to 624, where the valve cleaning strategy is executed. After 622 and 624 the control strategy ends or alternatively returns to the start.

Figure 7:
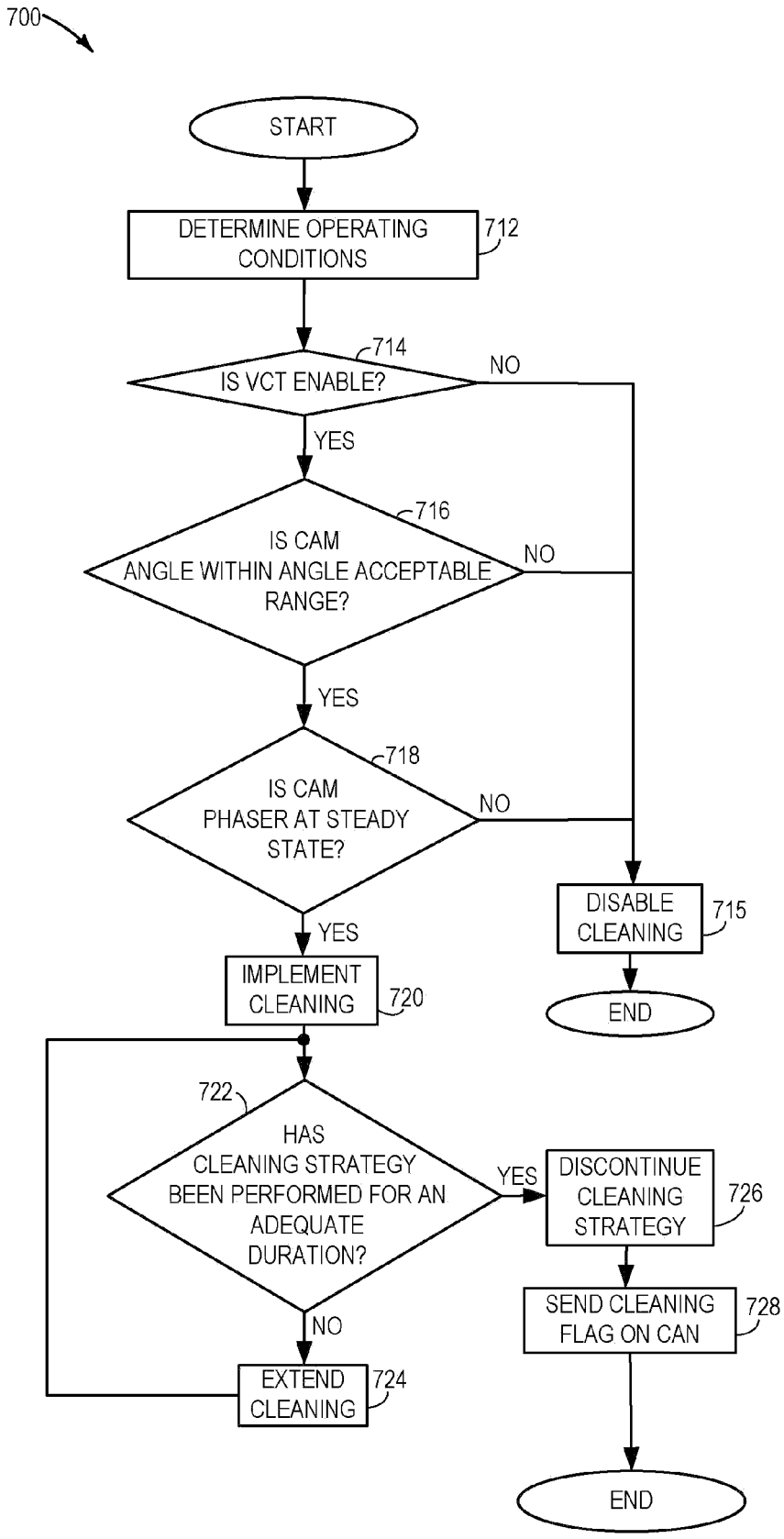
FIG. 7 shows an oil control valve cleaning strategy.

FIG. 7 shows a control strategy 700 which may be implemented at periodic, or other, intervals to determine if valve cleaning should be performed during combustion operation of the engine. In other examples, the control strategy may be implemented at varying intervals, or when selected conditions are present, during operation of the engine.

At 712, operating conditions are determined which may include actual cam angle and targeted cam angle, where engine temperature, exhaust gas composition, injection timing, etc. may be used to determine the target cam angle.

Next, the control strategy proceeds to 714 where it is determined if Variable Cam Timing VCT operation is enabled. VCT operation may include a period of operation when the position of the cams are advanced or retarded. For example, VCT operation may be implemented during combustion operation where sufficient oil pressure is present to actively control valve timing. If it is determined that VCT operation is not enabled, the control strategy advances to 715 where cleaning is disabled and subsequently the strategy ends or alternatively returns to the start.

However, if it is determined that VCT operation has been enabled, the control strategy advances to 716, where it is determined if the cam angle is within an acceptable range, which may be predetermined. Alternatively, it may be determined if the cam phaser is positioned within a specified range. For example, it may be determined if the cam phaser is positioned at a suitable angle away from the hard stops, such as at least 5 degrees from the hard stops. Alternatively, it may be determined if the cam phaser is locked into position at either of the hard stops. The desired range may be calculated utilizing various parameters, such as cam angle at energized and de-energized hard-stop, engine temperature, valve timing, etc. If the cam angle is not within an acceptable range, the control strategy proceeds to 715.

The cam phaser may advance or retard the angle of the cam relative to the camshaft. Therefore, the cam angle may be continuously changing. However, the relative position (e.g., deviation of the cam from a standard cam angle) may be either advanced or retarded.

If it is determined that the cam angle is within an acceptable range, the routine advances to 718 where it is determined if the cam phaser is at a substantially steady state. In some examples, it may be determined if the cam phaser has been at a steady state for a predetermined period of time. Steady state may include a rate of change of a measured cam angle being less than a threshold amount. It can be appreciated that a substantially steady state may be determined based on a range, which may be predetermined, of cam phaser positions (e.g. angles). The range may be determined utilized variables which may include sensor accuracy, engine temperature, hydraulic fluid pressure in one or more locations in the oil control valve, etc. If it is determined that the cam phaser is not at a steady state, the strategy proceeds to 715.

However, if it is determined that the cam phaser is at a substantially steady state, the routine advances to 720 where a cleaning strategy is implemented. The cleaning strategy may include cleaning strategy 800 or another suitable cleaning strategy.

The strategy then advances to 722, where it is determined if the valve cleaning strategy has been performed for an adequate duration, such as an amount of time. The adequate time interval may correspond to a predetermined time interval proportional to the number of switching event performed in the cleaning cycle. A switching event may include an event wherein the state of the oil control valve is adjusted via a command signal (e.g. duty cycle).

If it is determined that the valve cleaning cycle has not been performed for an adequate amount of time, the control strategy advances to 724 where the valve cleaning strategy is extended. Subsequent to 724, the routine returns to 722. However, if it is determined that the cleaning cycle has been performed for an adequate amount of time, the cleaning strategy is discontinued at 726. At 728, a cleaned flag is set. After 728, the routine ends or alternatively may return to the start.

Figure 8:
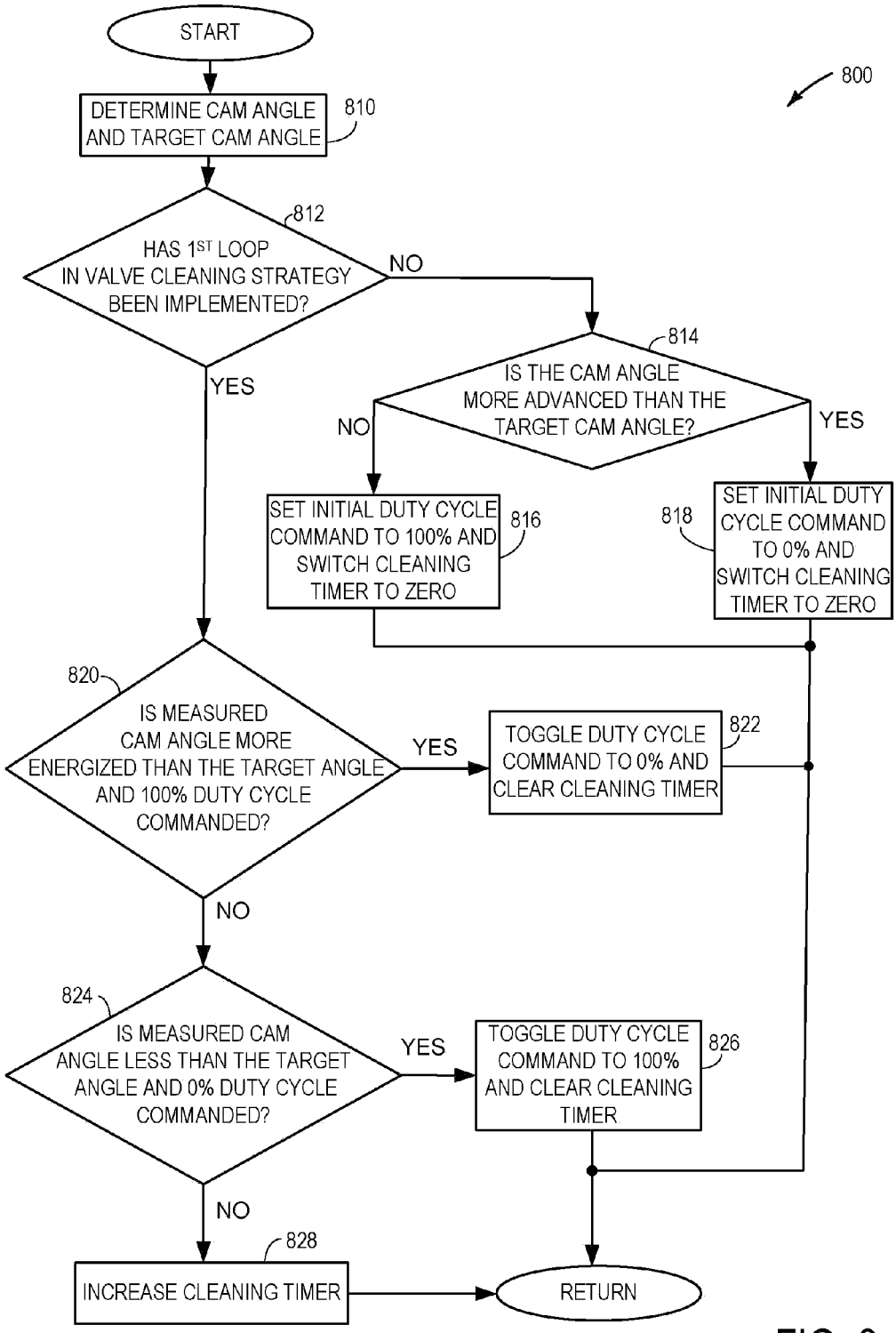
FIG. 8 shows an oil control valve cleaning strategy.

FIG. 8 shows a control strategy 800 which may be implemented at 720, shown in FIG. 7. In one example, control strategy 800 abruptly adjusts the oil control valve between two commanded states (via duty cycle adjustments) responsive to a range of positions of the cam phaser or cams to provide both valve cleaning as well as feedback cam angle control. The cam or cam phaser range may be proportioned so as not to affect operation of the engine or vehicle, in some example. Control strategy 800 may be referred to as valve cleaning strategy. In some examples, the control strategy 800 may include bang-bang limit cycle cam angle feedback control.

First, at 810, the cam angle or cam phaser angle and the targeted cam angle or cam phaser angle are determined. In some examples, a targeted cam angle or cam phaser angle deviation or range may also be determined. The targeted cam angle range may be determined based on various parameters, such as engine temperature, valve timing, etc. Additionally, a cleaning timer may be initiated. The cleaning timer may be configured to measure the duration of a commanded state of the valve. Next, at 812, it is determined if this is the first loop in the valve cleaning strategy, after the valve cleaning strategy has been initiated (e.g., a transition into cleaning). If it is determined that this is the first loop in the valve cleaning strategy, the strategy advances to 814 where it is determined if the actual cam angle is more advanced than the targeted cam angle. In one example, it may be determined if the cam angle and target cam angle deviation is greater than a threshold value. Therefore, in the aforementioned example, the target cam angle may be a range of cam angles with an upper and lower switching trigger. The upper and lower triggers may include minimum and maximum cam position threshold values.

If it is determined that the actual cam angle is more advanced than the targeted cam angle, the strategy proceeds to 816 where the valve command signal (e.g. duty cycle) is changed to 100% (or to a substantially energized condition) and a cleaning timer is switched to zero. Alternatively, it may be determined that the cam angle has reached or surpassed an upper switching trigger. The upper switching trigger may be proportional to the upper limit of cam angle range. It can be appreciated that alternate command states may also be used. After 816 the routine may return to the start.

However, if it is determined that the actual cam or cam phaser angle is retarded from the targeted cam angle, the strategy proceeds to 818 wherein the valve command signal is changed to 0% (or substantially de-energized) and the cleaning timer is switched to zero. Alternatively, it may be determined if the cam angle has reached or surpassed a lower switching trigger. The lower switching trigger may be proportional to the lower limit of the cam angle range. After 818, the strategy returns to the start.

On the other hand, if the valve cleaning strategy is not in it first loop, the strategy advances to 820 where it is determined if the actual cam angle is greater than the target angle and the valve is commanded with a 100% duty cycle. Alternatively, it may be determined if the cam angle has exceeded an upper switching trigger.

If it is determined that the actual cam angle is greater than the target angle and the valve is commanded with a 100% duty cycle, the strategy advances to 822 where the command signal is toggled to 0% and the cleaning timer is cleared. After 822, the strategy may return to the start or alternatively the strategy may end.

However, if the actual cam angle is not greater than the targeted angle and/or the valve command signal is not 100% duty cycle, the strategy advances to 824 where it is determined if the measured cam angle is less than the desired cam angle (e.g., retarded from) and the valve command signal is 0% duty cycle. Alternatively, it may be determined if the cam angle has surpassed a lower switching trigger. If it is determined that the measured cam angle is less than the desired cam angle and the valve command signal is 0% duty cycle, the strategy advances to 826 where the command signal is toggled to 100% and the cleaning timer is cleared. After 826, the strategy may return to the start or alternatively the strategy may end.

However, if it is determined that the measured cam angle is not less than the desired cam angle and/or the valve command signal is not 0% duty cycle, the strategy proceeds to 828 where the cleaning timer is increased by the amount of time since the last execution loop of the valve cleaning strategy. After 828, the strategy returns to the start, where another loop of the valve cleaning strategy is implemented. It can be appreciated that the valve cleaning strategy may be discontinued after a predetermined number of loops.

Figure 9:
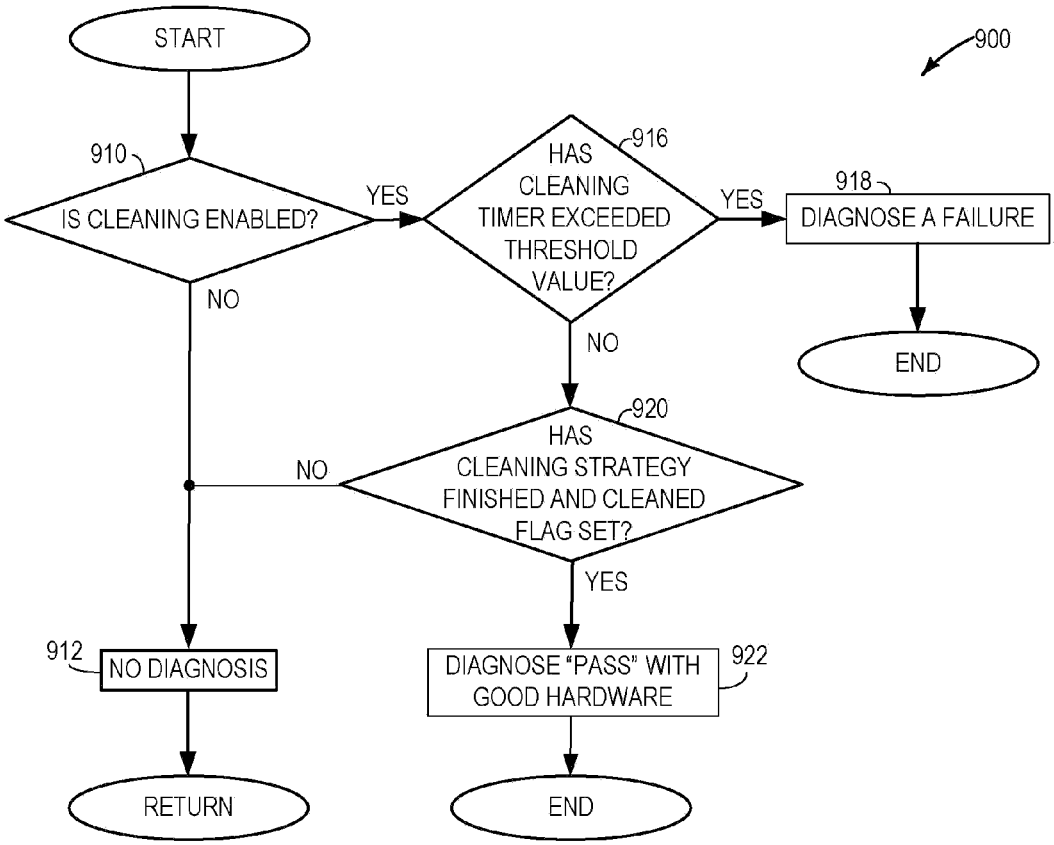
FIG. 9 shows an oil control valve cleaning strategy.

FIG. 9 illustrates a valve control strategy which may be implemented to diagnose if the valve actuation is slow or sluggish. First, at 910, it is determined that a valve cleaning strategy, such as strategy 800, is currently being implemented. If it is determined that a valve cleaning strategy is not being implemented, the strategy advances to 912 where no diagnosis is made and subsequently the strategy ends or alternatively returns to the start.

However, if it is determined that a valve cleaning strategy is being implemented, the strategy advances to 916 where it is determined if the cleaning timer has exceeded a threshold value, which may be predetermined. A number of variables may be used to calculate the threshold value such as engine temperature, valve timing, etc. If it is determined that the cleaning timer has exceeded a threshold value, the strategy advances to 918 where degradation of the variable cam timing system is diagnosed and in some examples a slow hardware indication may be set. After 918, the strategy ends. In some examples, after 918 valve cleaning may be inhibited.

However, if it is determined that the cleaning timer has not exceeded a threshold value, the strategy advances to 920 where it is determined if the valve cleaning strategy has finished and a cleaned flag has been set. If it is determined that the cleaning strategy has not finished, the strategy proceeds to 912 where no diagnosis is made. Subsequent to 912, the strategy may return to the start or ends. On the other hand, if it is determined that the valve cleaning strategy has finished and a cleaned flag has been set, the strategy advances to 922 where a pass diagnosis with good hardware is set (e.g., it is determined that the oil control valve is sufficiently functioning). After 922, the strategy ends or alternatively may return to the start.

Figure 10:
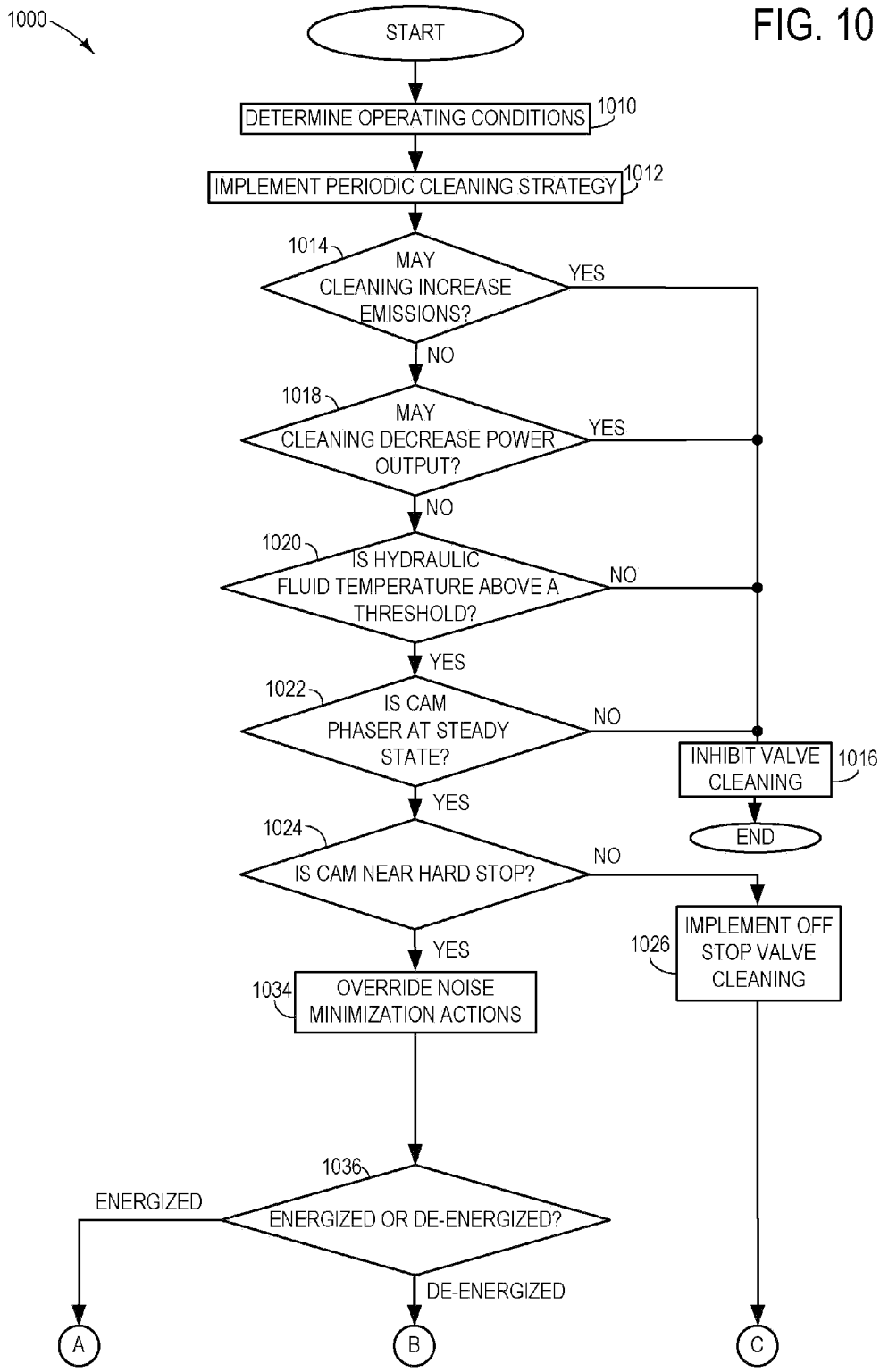
FIG. 10 shows an oil control valve cleaning strategy.
Figure 10:
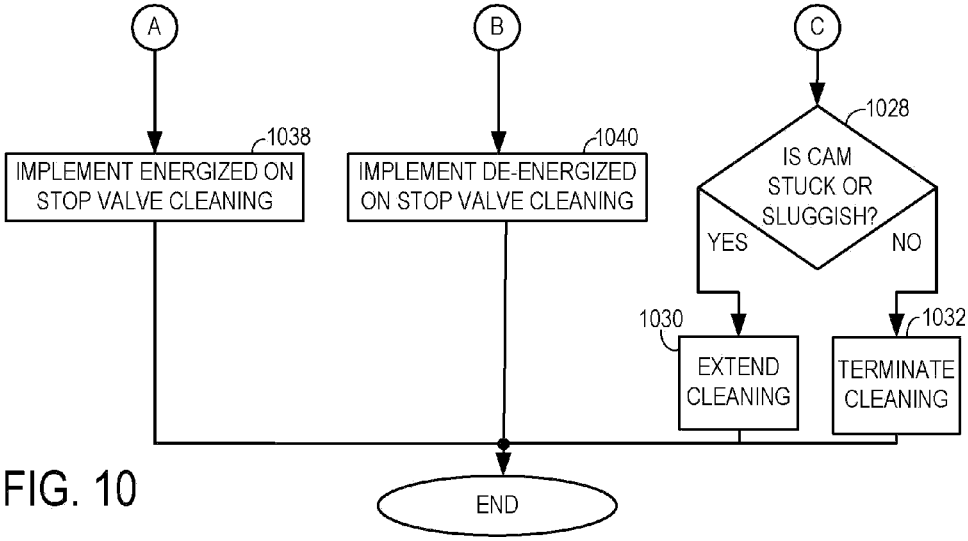

FIG. 10 illustrates an additional valve cleaning strategy 1000 which may be implemented to clean an oil control valve over a wide range of cam angles. The valve cleaning strategy allows cleaning to occur during operation of the engine without substantially degrading the performance of the engine.

At 1010, strategy 1000 includes determining operating conditions. The operating conditions may include: engine or vehicle temperature, air fuel ratio, throttle positions, etc. The strategy then proceeds to 1012 where a periodic cleaning strategy is implemented. The periodic cleaning strategy may be carried out during combustion operation of the engine and/or during periods of operation such as Deceleration Fuel Shut Off DFSO, periods of idle, etc., if present. It can be appreciated that the time interval between cleaning cycles may be adjusted in response to a number of engine operating conditions.

Next, the strategy proceeds to 1014 where it is determined if the cleaning cycle may increase emission from the vehicle. If it is determined that the valve cleaning cycle may increase emissions, the strategy advances to 1016 where valve cleaning is inhibited. After 1016 the strategy ends. However, if implementing the cleaning cycle may not increase emissions, the strategy advances to 1018 where it is determined if the power output of the engine may be decreased during valve cleaning. Alternatively, it may be determined if the cleaning cycle may decrease the requested torque output beyond a threshold value. If valve cleaning may decrease the power output of the engine, the strategy proceeds to 1016.

However, if the cleaning cycle may not decrease the power output, the strategy advances to 1020 where it is determined if the hydraulic fluid temperature is above a threshold value. Alternatively, it may be determined if the engine temperature is above a threshold value. If it is determined that the hydraulic fluid temperature is not above a threshold temperature, the strategy proceeds to 1016. If the hydraulic fluid temperature is above a threshold value, the control strategy advances to 1022 where it is determined if the cam phaser is at a substantially steady state. If it is determined that the cam phaser is not at a substantially steady state, the strategy proceeds to 1016. However, if it is determined that the cam phaser is at a substantially steady state, the strategy advances to 1024 where it is determined if the cam phaser is proximate to the energized and/or de-energized hard-stop(s). If it is determined that the cam phaser is not proximate to either of the hard stops, the strategy advances to 1026 where off-stop valve cleaning is implemented. In some examples, strategy 800 and/or strategy 900 may be implemented. In other examples, another suitable off-stop valve cleaning strategy may be implemented.

After 1026, the strategy advances to 1028 where it is determined if the cam or cam phaser is stuck or sluggish. If it is determined that the cam or cam phaser is stuck or sluggish, the off-stop valve cleaning strategy is extended at 1030. For example, slow and/or sluggish cam actuation may be identified by monitoring rate of change of cam angle under selected advancing and/or retarding conditions, etc. After 1030 the strategy ends or alternatively returns to 1028.

On the other hand, if it is determined that the cam or cam phaser is not stuck or sluggish, the strategy may be terminated at 1032. Subsequent to 1032, the strategy ends or alternatively returns to the start. If it is determined that the cam or cam phaser is near the hard stops, the strategy advances to 1034 where noise minimization actions near the hard stops are overridden (e.g. inhibited). Noise minimization actions may include actuating a locking mechanism in the cam actuation system.

Figure 11:
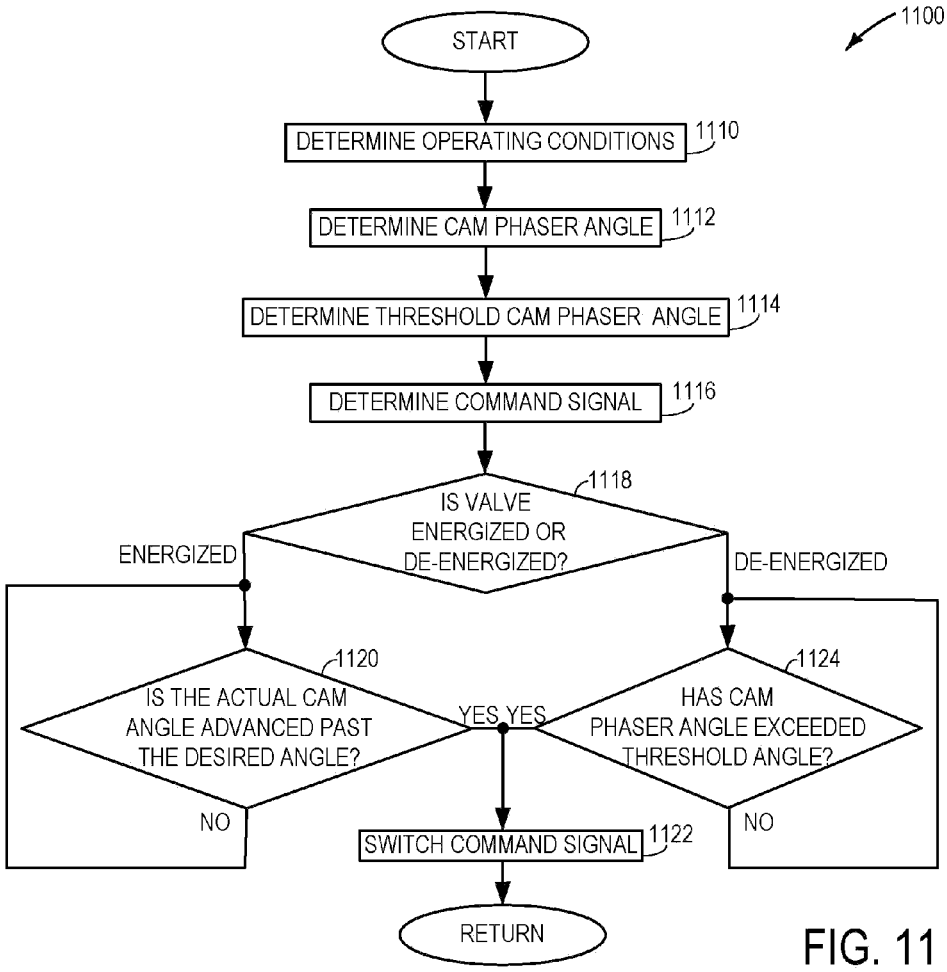
FIG. 11 shows an oil control valve cleaning strategy.
Figure 12:
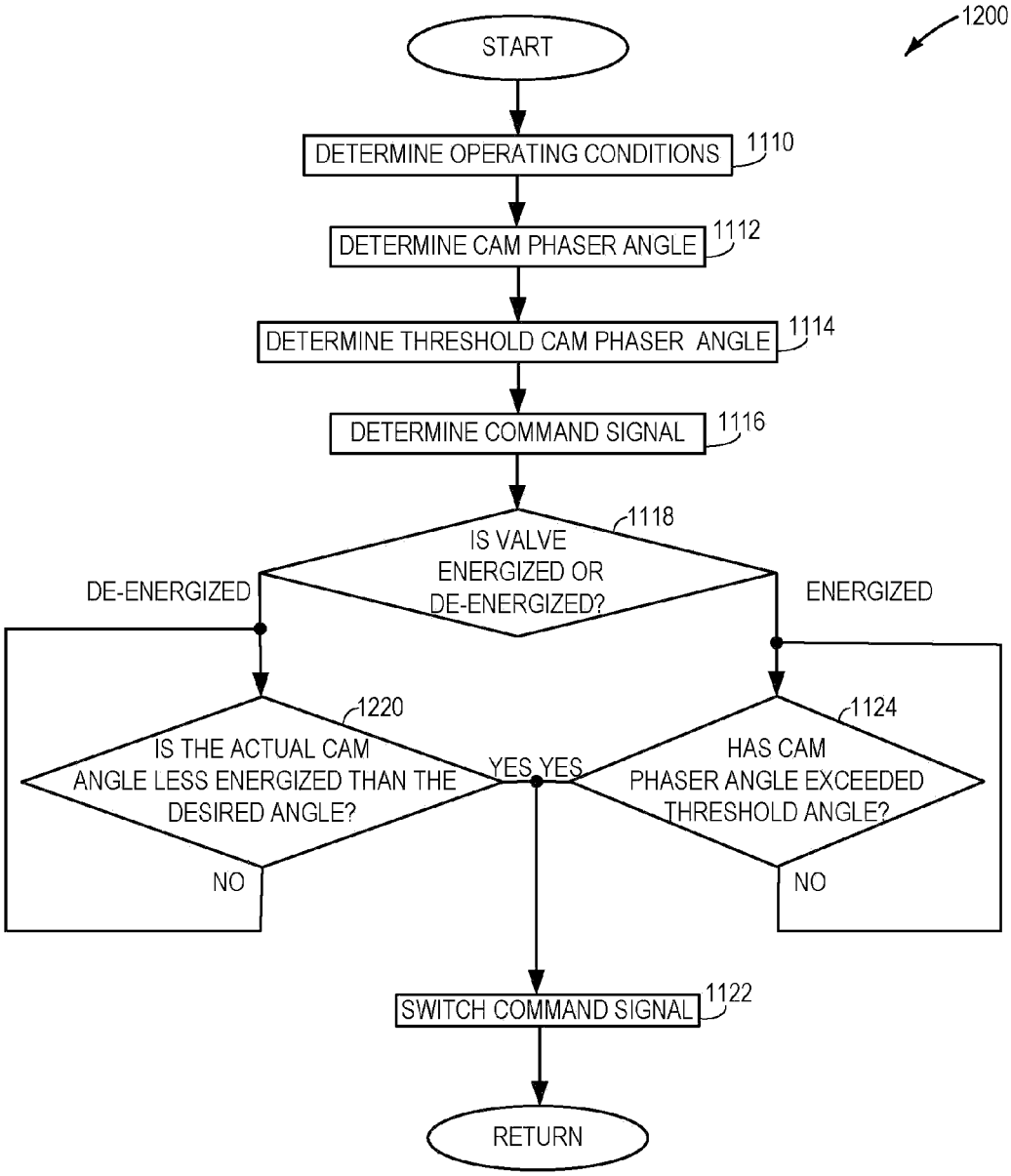
FIG. 12 shows an oil control valve cleaning strategy.

After 1034, the strategy advances to 1036 where it is determined if the cam or cam phaser is near an energized hard stop or a de-energized hard stop. If it is determined that the cam or cam phaser is near the energized hard stop, the strategy advances to 1038 where an energized on stop valve cleaning strategy is implemented. A suitable energized hard stop cleaning strategy is illustrated in FIG. 11. On the other hand, if it is determined that the cam phaser is near a de-energized hard stop, the strategy advances to 1040 where a de-energized on stop valve cleaning strategy is implemented. A suitable de-energized hard stop cleaning strategy is illustrated in FIG. 12.

FIG. 11 illustrates, a valve cleaning strategy 1100 that may be implemented while the cams or cam phaser are near an energized hard stop. First, at 1110, the vehicle operating conditions are determined. The operating conditions may include engine and/or vehicle temperature, valve timing, injection timing or profile, etc.

Next, the strategy advances to 1112 where the actual cam angle or cam phaser angle is determined. The strategy then advances to 1114 where the threshold cam or cam phaser angle is determined. Next, at 1116, the command signal (e.g. duty cycle) sent to the valve is determined. In some examples, a number of variables may be used to determine the command signal such as engine temperature, cam angle, desired cam angle, etc. In some examples, the command signal may have two discrete states (e.g. 100% duty cycle and 0% duty cycle).

Next, at 1118, it is determined if the valve is energized or de-energized. An energized command signal may correspond to 100% duty cycle. Conversely a de-energized command signal may correspond to 0% duty cycle. If it is determined that the command signal is energized, the strategy advances to 1120 where it is determined if the cam angle is advanced past the targeted angle. If so, the strategy advances to 1122 where the command signal is switched (e.g. toggled). After 1122, the strategy returns to the start.

However, if the answer to 1120 is NO, the strategy returns to 1120. In some examples, the strategy may be discontinued if the actual cam angle is not more energized than the targeted cam angle for a predetermined period of time.

On the other hand, if it is determined that the command signal is de-energized, it is determined if the cam angle has reached or surpassed the threshold angle at 1124. The threshold angle may be determined utilizing at least one of the following variable, engine temperature, valve timing, etc. In some examples, the threshold angle may be an angle below which movement of the cams does not adversely affect vehicle operation. If the cam angle has reached or surpassed the threshold angle, the strategy advances to 1122, after which the strategy returns to the start or alternatively ends. If the cam angle has not reached or surpassed the threshold angle, the strategy returns to 1124. In some examples the strategy may be discontinued after a predetermined amount of time if the threshold angle is not reached or surpassed.

FIG. 12 illustrates, a valve cleaning strategy 1200 that may be implemented while the cams or cam phaser is near a de-energized hard stop. Strategy 1200 is similar to strategy 1100, therefore similar steps are labeled accordingly. The strategy 1200 progresses in a similar manner to strategy 1100, until step 1118.

If at 1118 it is determined that the valve is de-energized the strategy advances to 1220 where it is determined if the actual cam angle is less than the desired cam angle. If the actual cam angle is less than the desired cam angle, the strategy advances to 1122. However, if the actual cam angle is not less than the desired cam angle, the strategy returns to 1220. On the other hand, if the valve is energized the strategy advances to 1124.

FIGS. 13A-13C, graphically illustrates a prior art valve cleaning strategy which may be implemented at selected time intervals such as at Deceleration Fuel Shut Off (DFSO) while fuel injection is not occurring. In particular, FIG. 13A illustrates the angle 1300 of one or more cams included in an engine. A maximum cam angle 1302 is shown in FIG. 13A. FIG. 13B illustrates a timer which may be used to switch the command signal to the valve at predetermined periodic time intervals. When the timer exceeds a threshold value 1304, the commanded state (e.g. duty cycle) of the valve is switched. FIG. 13C illustrates the duty cycle percentage sent to the valve. The command signal is either 100% PWM or 0% PWM. In this examples, when the cam angle exceeds the maximum cam angle (e.g. cam movement is detected) the PWM signal is switched to a 0% duty cycle or a low duty cycle.

FIGS. 14A-14C graphically illustrates how a valve cleaning control strategy may be implemented in the present disclosure. FIG. 14A shows an angle vs. time graph for a cam. FIG. 14B shows a graphical depiction of a cleaning timer. The global time is on the x-axis and a relative time is on the y-axis. FIG. 14C shows the commanded state of the valve vs. time. In this example the commanded state is a duty cycle percentage. A commanded cam angle 1400, an upper switching trigger 1402, a lower switching trigger 1404, and a cam angle 1406, are shown in FIG. 14A. When the cam angle exceeds the lower switching trigger or upper switching trigger, the commanded state of the valve is abruptly switched from a high duty cycle 1408 to a low duty cycle 1410, as shown in FIG. 14C. The high duty cycle may correspond to 100% PWM signal and the low duty cycle may correspond to a 0% PWM signal. FIG. 14B illustrate a cleaning timer which may be reset each time the commanded state of the valve is changed. The commanded state of the valve may be switched if the relative time surpasses a threshold value 1412, regardless of the cam angle or commanded cam angle.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and nonobvious combinations and subcombinations of the various systems and configurations, and other features, functions, and/or properties disclosed herein.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for operating an oil control valve coupled to a cam phaser configured to adjust a position of at least one cam between hard stops, the oil control valve included in an internal combustion engine having an intake valve and/or an exhaust valve controlled via the cam phaser, the method comprising:

operating the oil control valve responsive to cam position feedback information, the oil control valve adjusted in a first relationship based on the feedback information; and operating the oil control valve in a cleaning mode during select combustion conditions by abruptly switching the oil control valve between two states responsive to the cam position feedback information, the oil control valve adjusted in a second relationship based on the feedback information, the second relationship including more abrupt adjustment than the first relationship; operation in the cleaning mode including selecting two states based on cam position reaching either an upper threshold or reaching a lower threshold, and where the upper and lower thresholds are adjusted based on at least one of a commanded cam angle, an engine temperature, a valve position, and a measured cam angle.

2. The method of claim 1 wherein the cleaning mode operation occurs while the cam is at a substantially steady state and the cam is positioned within a given range away from the hard stops.

3. The method of claim 2 wherein the steady state conditions include the cam phaser position being substantially unchanged for a duration, the duration based on engine operating conditions including duration of a combustion cycle.

4. The method of claim 3 wherein the first relationship includes proportional and derivative control based on the feedback information.

5. The method of claim 1 where different engine banks operate independently according to the first and second relationships.

6. The method of claim 1 further comprising discontinuing the cleaning mode based on a cleaning mode duration or a deviation between the commanded cam angle and the measured cam angle.

7. A hybrid-electric propulsion system of a vehicle, comprising:

an engine including at least one cam coupled to a cam phaser, the cam phaser configured to adjust the cam between hard stops, the engine further including an oil control valve hydraulically coupled to the cam phaser;

an energy conversion device configured to provide motive force to drive the vehicle;

an energy storage device including a battery; and a control system configured to adjust engine operation, including shutting down engine operation during vehicle operation; and to adjust valve timing of the engine by adjusting the oil control valve during engine operation, the control system further configured to adjust the oil control valve responsive to cam position based on a first relationship during a first mode, and to adjust the oil control valve responsive to the cam position based on a second relationship during a second mode, the second relationship including abrupt switching of the oil control valve between two states responsive to the cam position with the second relationship including more abrupt adjustment than the first relationship, the second mode including operation of the cam away from the hard stops, and the second mode occurring during selected engine operating conditions, wherein the second mode includes switching the oil control valve between two states, each near an end region of the valve actuation, and switching based on cam position thresholds, where the thresholds are adjusted based on at least one of a commanded cam angle, an engine temperature, a valve position, and a measured cam angle.

8. The system of claim 7 wherein the selected engine operating conditions include at least one of a steady state cam position, an engine temperature, an exhaust gas composition, and an output torque.

9. The system of claim 8 wherein at least one of the selected engine operation conditions are predicted.

10. The system of claim 7 wherein the control system is configured to adjust the oil control valve during engine combustion.

11. The system of claim 7 wherein the first mode occurs more often than the second mode during engine operation.

12. The system of claim 7 wherein the first relationship includes proportional integral derivative feedback control and the second relationship includes a bang-bang limit cycle control.

13. The system of claim 7 wherein the second mode is a valve cleaning mode.

14. The system of claim 13 wherein the cleaning mode is discontinued based on a cleaning mode duration or a deviation between the commanded cam angle and the measured cam angle.

15. The system of claim 7 wherein the control system switches from the second mode to the first mode based on rate of change of cam angle.

16. The system of claim 7 wherein the control system switches from the second mode to the first mode based on at least one of an oil temperature, an engine torque, an exhaust gas composition, and the cam position.

17. A method for operating an oil control valve coupled to a cam phaser configured to adjust a position of at least one cam between hard stops, the oil control valve included in an internal combustion engine having an intake valve and/or an exhaust valve controlled via the cam phaser, the engine coupled in a vehicle having an electric machine configured to drive the vehicle, the method comprising:

selectively shutting down the internal combustion engine and driving the vehicle with the electric machine;

during engine operation, operating the oil control valve responsive to cam position feedback information, the oil control valve adjusted based on the feedback information; and during engine operation, operating the oil control valve in a cleaning mode during select conditions by abruptly switching the oil control valve between two states, the oil control valve adjusted more abruptly in the cleaning mode than during non-cleaning conditions, the abrupt adjustment including abruptly switching commanded states of the oil control valve between a first and second extreme state in response to a parameter exceeding an upper limit of deviation or a lower limit of deviation, to clean the valve in the cleaning mode, where the upper and lower limits of deviation are adjusted responsive to an operating condition, and where selection of the cleaning mode is responsive to a quantity of engine shut down operations.

18. The method according to claim 17 wherein the frequency of selection of the cleaning mode during engine combustion operation is adjusted responsive to the quantity of engine shut down operations.

19. The method according to claim 17 wherein the frequency of selection of the cleaning mode during engine combustion operation is increased responsive to an increase in the number or duration of engine shut down operations.

* * * * *